US010584555B2

(12) United States Patent
Leonardi et al.

(10) Patent No.: US 10,584,555 B2
(45) Date of Patent: Mar. 10, 2020

(54) SYSTEM AND METHOD FOR ISOLATING A SECTION OF A WELL

(71) Applicant: Schlumberger Technology Corporation, Sugar Land, TX (US)

(72) Inventors: Tauna Lea Leonardi, Pearland, TX (US); Idalia Ovalle Stevenson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 400 days.

(21) Appl. No.: 15/040,088

(22) Filed: Feb. 10, 2016

(65) Prior Publication Data

US 2017/0226820 A1 Aug. 10, 2017

(51) Int. Cl.

| | |
|---|---|
| ***E21B 33/12*** | (2006.01) |
| ***E21B 33/124*** | (2006.01) |
| ***E21B 17/20*** | (2006.01) |
| ***E21B 19/22*** | (2006.01) |
| ***E21B 33/122*** | (2006.01) |
| ***E21B 33/128*** | (2006.01) |
| ***E21B 33/129*** | (2006.01) |
| ***E21B 33/134*** | (2006.01) |
| ***E21B 43/26*** | (2006.01) |
| ***E21B 23/00*** | (2006.01) |
| ***E21B 23/06*** | (2006.01) |
| ***E21B 43/14*** | (2006.01) |

(52) U.S. Cl.

CPC ..... *E21B 33/124* (2013.01); *E21B 17/20* (2013.01); *E21B 19/22* (2013.01); *E21B 23/006* (2013.01); *E21B 23/06* (2013.01); *E21B 33/122* (2013.01); *E21B 33/128* (2013.01); *E21B 33/1293* (2013.01); *E21B 33/134* (2013.01); *E21B 43/14* (2013.01); *E21B 43/261* (2013.01)

(58) Field of Classification Search

CPC ..... E21B 17/20; E21B 19/22; E21B 23/004; E21B 23/006; E21B 23/06; E21B 33/122; E21B 33/124; E21B 33/128; E21B 33/134; E21B 33/14; E21B 43/261; E21B 33/1293; E21B 43/14

See application file for complete search history.

(56) References Cited

U.S. PATENT DOCUMENTS

| | | | | |
|---|---|---|---|---|
| 3,169,579 | A * | 2/1965 | Haines | E21B 33/124 166/119 |
| 7,617,873 | B2 | 11/2009 | Lovell et al. | |
| 2007/0068676 | A1* | 3/2007 | Shkurti | E21B 33/124 166/308.1 |
| 2008/0314600 | A1* | 12/2008 | Howard | E21B 23/006 166/387 |
| 2011/0127047 | A1* | 6/2011 | Themig | E21B 34/063 166/386 |

(Continued)

*Primary Examiner* — Robert E Fuller
*Assistant Examiner* — Christopher J Sebesta

(57) ABSTRACT

A technique facilitates servicing of a subterranean formation by treating a specific section of a well. The technique utilizes a straddle packer conveyed downhole and then activated via coiled tubing. The straddle packer comprises a first, e.g. upper, packer and a second, e.g. lower, packer which are deployed downhole into the wellbore to the specific section of the wellbore proximate a target formation zone. Once properly located, the straddle packer is uniquely activated by compression and tension inputs applied via the coiled tubing.

20 Claims, 5 Drawing Sheets

(56) References Cited

U.S. PATENT DOCUMENTS

2011/0284233 A1* 11/2011 Wu ..... E21B 10/32
166/321
2013/0062073 A1* 3/2013 Landsiedel ..... E21B 33/1243
166/378
2015/0376975 A1* 12/2015 Flores ..... E21B 33/124
166/377

* cited by examiner

SYSTEM AND METHOD FOR ISOLATING A SECTION OF A WELL

BACKGROUND

In a variety of well servicing applications, a specific section of a well and the surrounding subterranean formation are treated without treating the entire well. Isolating a specific section of the well eliminates exposure of the whole well to the treatment substances during servicing. The isolation of a specific well section also focuses injection of the treatment substance on a specific target formation zone and likely reduces the amount of treatment substance injected. Packers may be employed to isolate the specific section of the well during the period of time the well treatment fluid is injected into the target formation zone.

SUMMARY

In general, the present disclosure provides a system and methodology which facilitate servicing of a subterranean formation by treating a specific section of a well. The system and methodology utilize a straddle packer conveyed downhole and then activated via coiled tubing. The straddle packer comprises a first, e.g. upper, packer and a second, e.g. lower, packer which are deployed downhole into the wellbore to the specific section of the wellbore proximate a target formation zone. Once properly located, the straddle packer is subsequently activated by compression and tension inputs applied via the coiled tubing.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
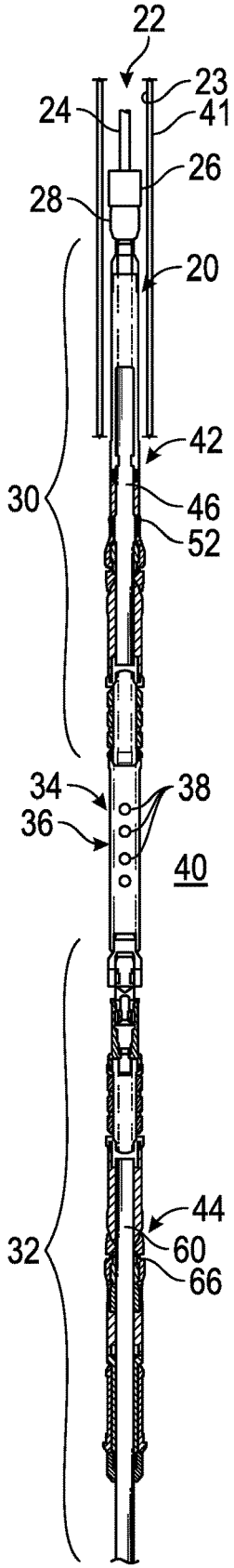
FIG. 1 is an illustration of an example of a straddle packer system deployed downhole into a wellbore by coiled tubing, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for facilitating servicing of a subterranean formation by treating a specific section of a well. The system and methodology utilize a straddle packer assembly conveyed downhole and then activated via coiled tubing. A coiled tubing assembly, such as that shown in U.S. Pat. No. 7,617,873, the entire disclosure of which is incorporated by reference herein its entirety, may include surface pumping facilities, a coiled tubing string mounted on a reel, a method to convey the coiled tubing into and out of the wellbore, such as an injector head or the like, and surface control apparatus at the wellhead. Coiled tubing has been utilized for performing well treatment and/or well intervention operations in existing wellbores such as, but not limited to, hydraulic fracturing, matrix acidizing, milling, perforating, coiled tubing drilling, and the like. The system of the present disclosure provides a temporary, resettable straddle packer assembly which may be installed, for example, during a relatively short period of time for treatment at a specific zone of a well. The straddle packer assembly comprises a first, e.g. upper, packer and a second, e.g. lower, packer which are deployed downhole into the wellbore to the specific section of the wellbore proximate a target formation zone. It should be noted the terms "upper" and "lower" are used herein for convenience and typically refer to the orientation illustrated in a corresponding figure, however such terms should not be construed as limiting the overall system to a specific orientation. Depending on the application, the overall system can be used in a variety of orientations in, for example, deviated wellbores.

Once the straddle packer is located at a desired location along the wellbore, the straddle packer is activated by compression and tension inputs applied via the coiled tubing. The straddle packer may be cycled through a plurality of positions, e.g. configurations, depending on the stage of the well servicing application. Additionally, the straddle packer may be utilized in a wide variety of formation treatments, such as hydraulic fracturing. For example, the straddle packer described herein may be used to provide an unrestricted, open flow path for pumping the high-pressure, solids-laden fracturing fluids into the surrounding formation. Additionally, the straddle packer may be set and reset repeatedly.

According to an embodiment, the straddle packer comprises the upper packer, the lower packer, and a middle or intermediate section which includes an injection mandrel having ports for injecting treatment fluid into a surrounding, isolated well zone. Both the upper and lower packers may comprise compressible material which can be squeezed into sealing engagement with the surrounding wellbore wall. Additionally, the straddle packer may be deployed by coiled tubing and then selectively actuated via the coiled tubing between a plurality of positions. An indexing mechanism, such as a J-slot mechanism, may be used in cooperation with the pushing (compression) and pulling (tension) inputs applied by the coiled tubing. The pushing and pulling inputs may be used to cycle the straddle packer to a first position for moving into the well, a second position for pulling out of the wellbore or preparing to activate the straddle packer, and a third position for sealing the target zone by activating the straddle packer to facilitate pumping of treatment fluid into the sealed-off zone.

Referring generally to FIG. 1, an example of a straddle packer assembly 20, referred to herein as a straddle packer, is illustrated as deployed in a wellbore 22 defined by a wellbore wall 23. The straddle packer 20 is deployed downhole into the wellbore 22 to a desired treatment location by coiled tubing 24. By way of example, the coiled tubing 24 may be coupled to the straddle packer 20 by a coiled tubing connector 26 and a coiled tubing release device 28. The coiled tubing release device 28 provides a mechanism for disconnecting the straddle packer 20 from the coiled tubing 24, such as if the straddle packer 20 or other components below release device 28 become stuck in the wellbore 22.

In the example illustrated, the straddle packer 20 comprises a first or upper packer assembly 30 and a second or lower packer assembly 32 connected by a middle section 34 comprising an injection mandrel 36 having a plurality of injection ports 38. Treatment fluid, e.g. fracturing fluid, may be injected into a specific, isolated section of the wellbore 22 and out into a target formation zone 40. For example, the upper packer assembly 30 and the lower packer assembly 32 may be set to seal off the specific, isolated section of wellbore 22 and then the treatment fluid may be pumped out through injection ports 38 and into the target formation zone 40. In some applications, the wellbore 22 may be cased with a casing 41, and perforations (not shown) may be formed out through the casing 41 and into the surrounding formation at the target formation zone 40, as will be appreciated by those skilled in the art. Treatment fluid, e.g. hydraulic fracturing fluids, may then be delivered through mandrel injection ports 38 and injected under pressure into the perforations created in the surrounding formation.

Figure 2:
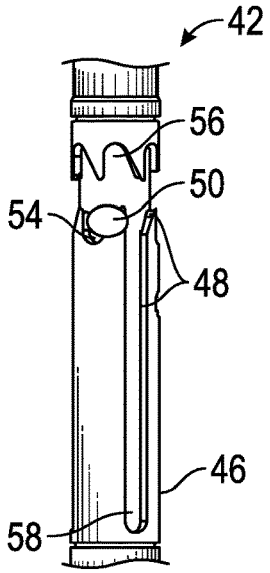
FIG. 2 is an illustration of a first, e.g. upper, J-slot mechanism for use in the straddle packer system illustrated in FIG. 1, according to an embodiment of the disclosure.
Figure 3:
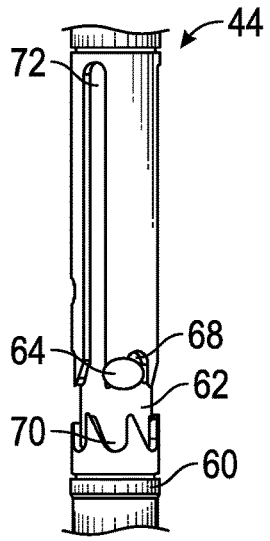
FIG. 3 is an illustration of a second, e.g. lower, J-slot mechanism for use in the straddle packer system illustrated in FIG. 1, according to an embodiment of the disclosure.

With additional reference to FIGS. 2 and 3, the straddle packer 20 also comprises a first or upper indexing mechanism 42, e.g. an upper J-slot mechanism, and a second or lower indexing mechanism 44, e.g. a lower J-slot mechanism. In the example illustrated, the upper J-slot mechanism 42 utilizes an internal mandrel 46 that defines a J-slot recess in the form of a multi-position profile 48 for receiving at least one pin 50. By way of example, the pin(s) 50 may be mounted to a surrounding housing 52, although the pin(s) 50 and profile 48 could be reversed with respect to the internal mandrel 46 and surrounding housing 52. In an embodiment, three pins 50 may be mounted to the surrounding housing 52. The three pins 50 extend inwardly into cooperation with profile 48 which has a repeating pattern that repeats, e.g. repeats three times, about the circumference of the internal mandrel 46. In the embodiment illustrated, the upper J-slot mechanism 42 may be actuated between three positions by effectively transitioning pins 50 to a first position 54, a second position 56, and a third position 58.

Similarly, the lower J-slot mechanism 44 utilizes an internal mandrel 60 that defines a J-slot recess in the form of a multi-position profile 62 for receiving at least one pin 64. By way of example, the pin(s) 64 may be mounted to a surrounding housing 66, although the pin(s) 64 and profile 62 could be reversed with respect to the internal mandrel 60 and surrounding housing 66. In an embodiment, three pins 64 may be mounted to the surrounding housing 66 such that they extend inwardly into cooperation with profile 62. As with the upper J-slot mechanism, the profile 62 may have a repeating pattern which repeats a desired number of times, e.g. three times, about the circumference of the internal mandrel 60. In the embodiment illustrated, the lower J-slot mechanism 44 may be actuated between three positions by effectively transitioning pins 64 to a first position 68, a second position 70, and a third position 72. In the illustrated embodiment, the upper J-slot mechanism 42 is generally inverted relative to the lower J-slot mechanism 44.

The upper J-slot mechanism 42 and the lower J-slot mechanism 44 are selectively operated to shift the straddle packer 20 between, for example, three straddle packer operational positions. The three straddle packer positions include a first position for moving into the well, a second position for pulling out of the well or preparing to activate packer sealing elements, and a third position for sealing the wellbore 22 at target formation zone 40 by actuating the sealing elements to facilitate pumping of treatment fluid into the target formation zone 40. The three positions may be selected by applying appropriate compression and tension inputs on coiled tubing 24, e.g. coiled tubing pushing for first position, coiled tubing pulling for second position, and coiled tubing pushing for third position.

Figure 4:
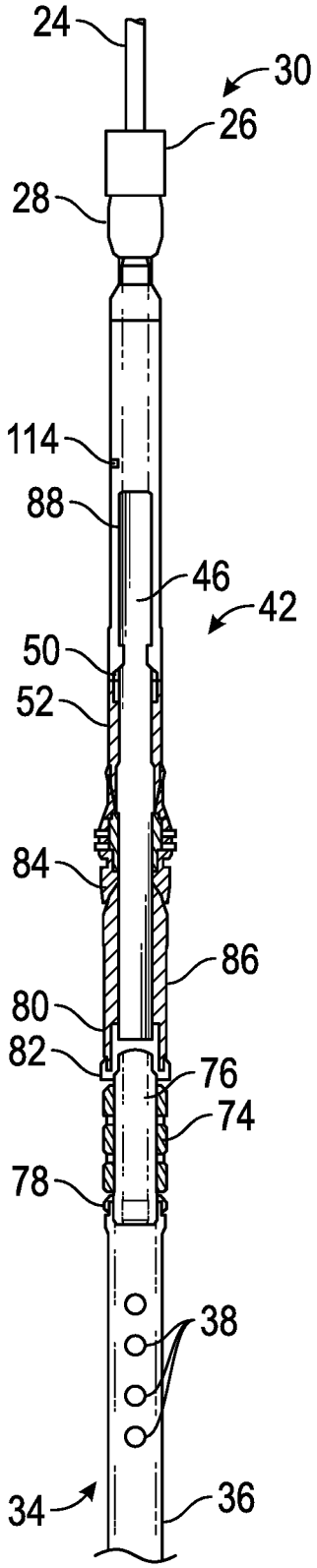
FIG. 4 is an enlarged view of the upper portion of the straddle packer system illustrated in FIG. 1, according to an embodiment of the disclosure.

Referring generally to FIG. 4, an enlarged view of upper packer 30 is illustrated as connected between coiled tubing 24 and middle section 34. As illustrated, the upper packer 30 may comprise various other components, such as a packer sealing element 74 positioned about a sealing element mandrel 76 which may be positioned between J-slot mandrel 46 and an end ring 78. In some embodiments, the sealing element mandrel 76 may be coupled with J-slot mandrel 46 via a mandrel coupling 80. The packer sealing element 74 may be selectively squeezed by shifting a sealing element end ring 82 and end ring 78 toward each other. The linear squeezing of sealing element 74 effectively forces the sealing element 74, e.g. an elastomeric sealing element, to expand in a radially outward direction and into sealing engagement with the surrounding surface 23, e.g. the interior surface of casing 41.

The upper packer 30 also may comprise a plurality of slips 84 which may be actuated via cooperation with a cone 86 to shift the slips 84 radially outward into engagement with the surrounding surface 23, e.g. the interior surface casing 41. Various seals also may be positioned between components of upper packer 30. For example, a seal 88 may be located between mandrel 46 and the surrounding housing 52 at one or more locations.

Figure 5:
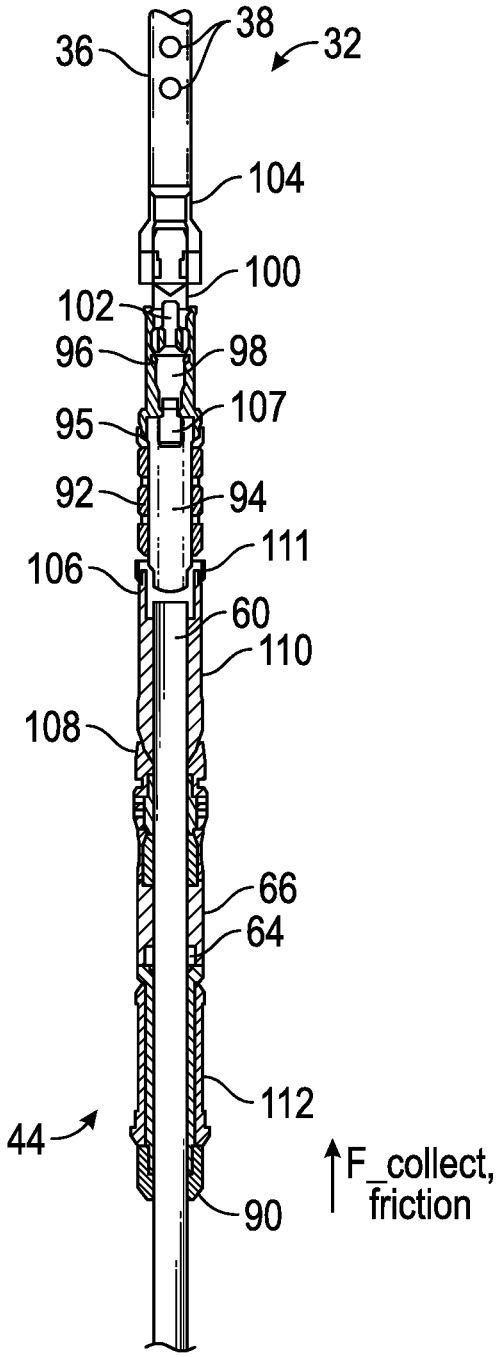
FIG. 5 is an enlarged view of the lower portion of the straddle packer system illustrated in FIG. 1, according to an embodiment of the disclosure.

In many applications, the lower packer 32 may be similarly constructed to that of upper packer 30. Referring generally to FIG. 5, an enlarged view of lower packer 32 is illustrated as connected between middle section 34 and a lower retainer 90. As illustrated, the lower packer 32 may comprise various other components similar to those of upper packer 30, e.g. a packer sealing element 92 positioned about a lower sealing element mandrel 94. The lower packer sealing element 92 may be positioned between lower J-slot mandrel 60 and an end ring 95, the end ring 95 being engaged by a bypass housing 96 containing a plug 98. In this embodiment, the bypass housing 96 is coupled with middle section 34 via an adapter 100, having an internal plug 102, and a connector 104. The sealing element mandrel 94 may be coupled with J-slot mandrel 60 via a mandrel coupling 106. Additionally, a centralizer 107 may be mounted at a suitable location, e.g. above sealing element 92 as illustrated.

Similar to that described above with respect to the upper packer 30, the lower packer sealing element 92, e.g. an elastomeric sealing element, may be selectively squeezed to force the sealing element 92 to expand in a radially outward direction. The radially outward movement forces the lower sealing element 92 into sealing engagement with the surrounding surface 23, e.g. the interior surface of casing 41.

The lower packer 32 also may comprise a plurality of slips 108 which may be actuated via cooperation with a cone 110 to shift the slips 108 radially outward into engagement with the surrounding surface 23, e.g. the interior surface casing 41. Generally, when the slips 108 are moved to the radially outward position, the packer sealing element 92 is compressed linearly against an element end ring 111 by the upper end ring 95. Various seals also may be positioned between components of lower packer 32. Additionally, the lower packer 32 may comprise a collet 112 located between retainer 90 and lower J-slot mechanism 44.

Figure 6:
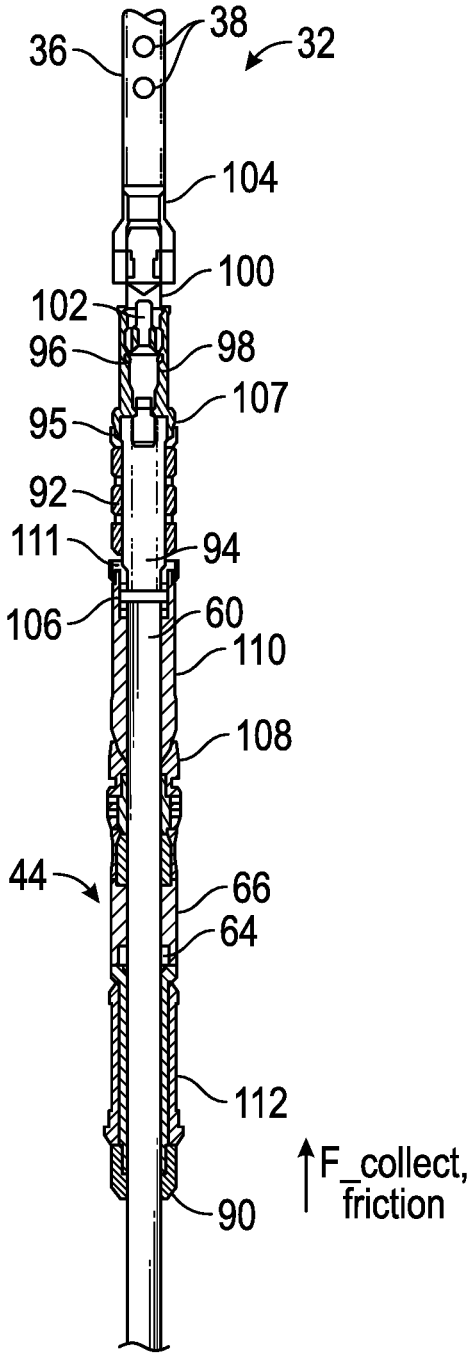
FIG. 6 is an illustration of the lower portion of the straddle packer system in a first operational position, according to an embodiment of the disclosure.
Figure 7:
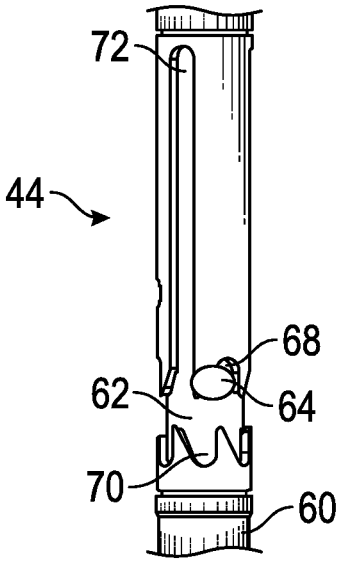
FIG. 7 is an illustration of the lower J-slot mechanism in a configuration corresponding with the first operational position of the straddle packer system, according to an embodiment of the disclosure.

Referring generally to FIGS. 6 and 7, a portion of the straddle packer 20 is illustrated in a configuration that results when the straddle packer 20 is activated to a first position. To achieve this first straddle packer position, the coiled tubing 24 pushes the straddle packer 20 downwardly in the bottom hole direction while the collet 112 drags against the surrounding wellbore surface with a slight friction reaction force. The pins 50 of the upper J-slot mechanism 42 are in position 54 and the pins 64 of lower J-slot mechanism 44 are in position 68, as illustrated in FIG. 7.

The coiled tubing 24 is rigidly connected, e.g. via threaded engagements, to the housing 52 via connector 26, release device 28, and sometimes additional housing sections. The slips 84 also are rigidly connected to housing 52 such that the housing 52 and slips 84 move together. However, housing 52 and mandrel 46 can slide with respect to each other except for the axial constraint provided by the position of pins 50 in the J-slot profile 48.

When the straddle packer 20 is in the first position for moving into the well, pins 50 are located in position 54. This position prevents the housing 52 and the slips 84 from moving down against cone 86, thus also preventing the slips 84 from anchoring against the surrounding wellbore wall 23. Having the pins 50 in position 54 also prevents cone 86 and element end ring 82 from compressing the packer sealing element 74. Consequently, the packer sealing element 74 of the upper packer 30 does not seal against the surrounding wellbore wall 23 when in this first straddle packer position.

As the coiled tubing 24 moves the upper packer 30 in the downhole direction, force is transmitted to the lower packer 32 through pins 50 pushing on mandrel 46 while pins 50 are held at position 54. The mandrel 46 is rigidly connected, e.g. threadably connected, to mandrel coupling 80 which, in turn, may be threadably or otherwise coupled in series with sealing element mandrel 76, injection mandrel 36, and connector 104. Connector 104 is coupled with, e.g. threadably connected to, adapter 100, and plug 102 may be screwed into the adapter 100. When pushed downwardly, adapter 100 slides into bypass housing 96, plug 102 slides into plug 98, and plug 98 slides into the lower sealing element mandrel 94. The centralizer 107 may be used to align plug 98 in sealing element mandrel 94.

The sealing element mandrel 94 may be coupled with, e.g. threadably coupled with, coupling 106 so as to push down on J-slot mandrel 60. The pins 64 of the lower J-slot mechanism 44 are located in the J-slot profile 62 at position 68 which prevents mandrel 60 from sliding down in a manner which would push cone 110 into slips 108. Consequently, the slips 108 do not expand outwardly and thus do not anchor against the surrounding wellbore wall. Also, because mandrel 60 and sealing element mandrel 94 do not slide down, the packer sealing element 92 does not get compressed against element end ring 111 and the packer sealing element 92 is not squeezed into sealing engagement with the surrounding wellbore wall 23. In this position, the straddle packer 20 may be moved downhole via coiled tubing 24 while overcoming frictional force that may result from collet 112 dragging along the surrounding wellbore wall surface 23.

Figure 8:
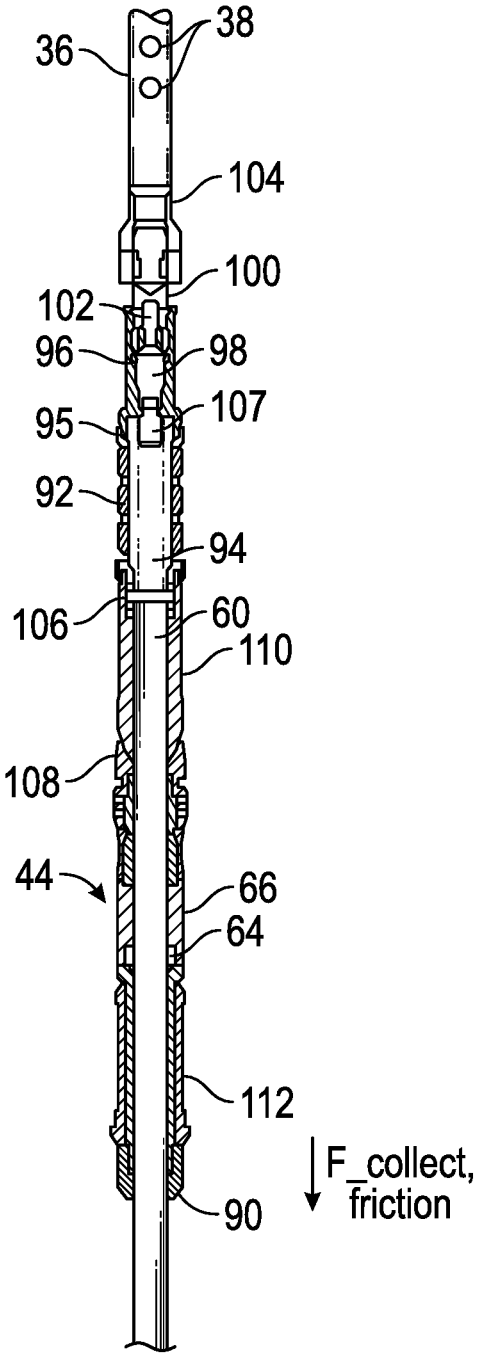
FIG. 8 is an illustration of the lower portion of the straddle packer system in a second operational position, according to an embodiment of the disclosure.
Figure 9:
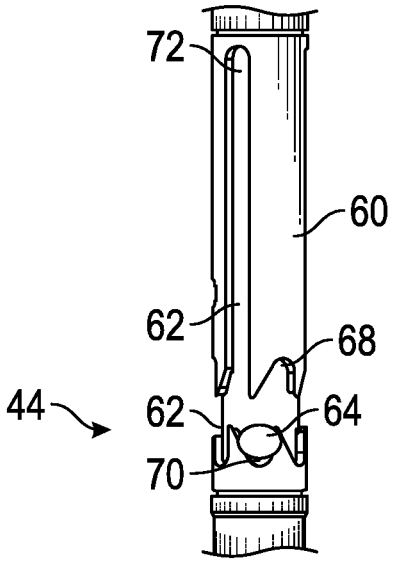
FIG. 9 is an illustration of the lower J-slot mechanism in a configuration corresponding with the second operational position of the straddle packer system, according to an embodiment of the disclosure.

Referring generally to FIGS. 8 and 9, a portion of the straddle packer 20 is illustrated in a configuration that results when the straddle packer 20 is actuated to a second straddle packer position. When the straddle packer 20 is transitioned from the first position, as described above, to the second position, the coiled tubing 24 changes from pushing the straddle packer 20 in the downhole direction to pulling the straddle packer 20 in the uphole direction. When the coiled tubing 24 is pulled to apply a tension input to straddle packer 20, pins 50 of upper packer 30 slide along the J-slot profile 48 to position 56 and the mandrel 46 is pulled upwardly which translates to mandrel 60 in lower packer 32.

As mandrel 60 is pulled upwardly, pins 64 are moved along the J-slot profile 62 into position 70, as illustrated in FIG. 9. The pins 64 are rigidly connected to housing 66 and thus able to pull upwardly on both housing 66 and collet 112. Collet 112 drags against the surrounding wellbore wall surface 23 with a slight friction force, and retainer 90 keeps the bottom fingers of collet 112 contained to prevent expanding. Due to the upper J-slot mechanism 42 and the lower J-slot mechanism 44 being in positions 56 and 70, respectively, neither slips 84 nor slips 108 anchor against the surrounding wellbore wall 23. Additionally, neither of the sealing elements 74 nor 92 is compressed to form a seal with the surrounding wellbore wall 23 and this allows the entire straddle packer 20 to be moved in an uphole direction.

Figure 10:
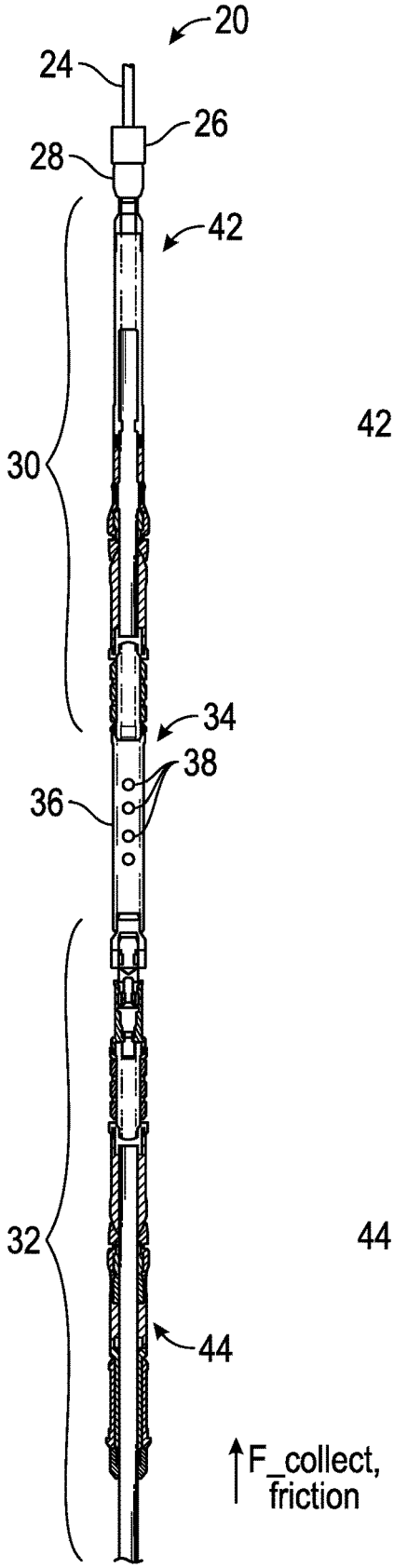
FIG. 10 is an illustration of straddle packer system in a third operational position, according to an embodiment of the disclosure.
Figure 11:
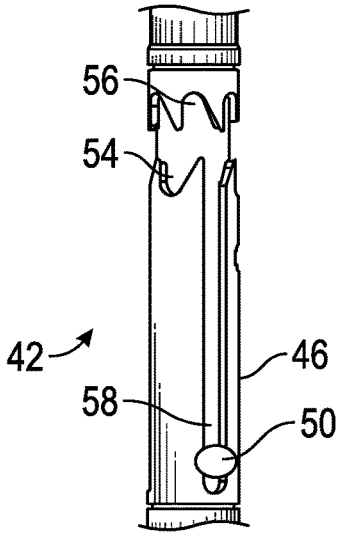
FIG. 11 is an illustration of the upper J-slot mechanism in a configuration corresponding with the third operational position of the straddle packer system, according to an embodiment of the disclosure.
Figure 12:
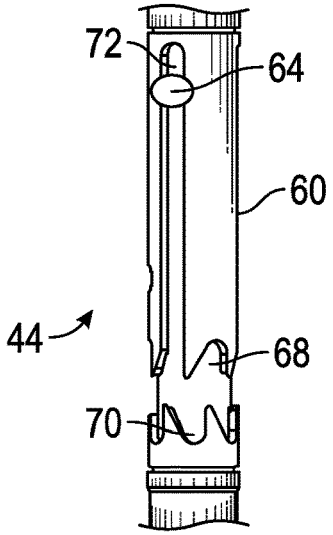
FIG. 12 is an illustration of the lower J-slot mechanism in a configuration corresponding with the third operational position of the straddle packer system, according to an embodiment of the disclosure.

Referring generally to FIGS. 10-12, the straddle packer 20 is illustrated in a third straddle packer position. When the straddle packer 20 is transitioned from the second position, as described above, to the third position, the input provided by the coiled tubing 24 is changed from pulling to pushing which may be slightly resisted by collet 112. The pushing action against straddle packer 20 in the downhole direction causes pins 50 of upper J-slot mechanism 42 to start sliding along J-slot profile 48 toward position 58, as illustrated in FIG. 11.

Consequently, the J-slot housing 52 and slips 84 start pushing down on cone 86. However, the slips 84 do not yet anchor against the surrounding wellbore wall and the packer sealing element 74 does not yet compress to form a seal because the lower packer assembly 32 has not yet been fixed. The lower packer 32 slides slightly downwardly along the wellbore 22 which causes mandrel 46, mandrel coupling 80, sealing element mandrel 76, injection mandrel 36, connector 104, and the adapter 100 on lower packer 32 to be pushed downwardly. This downward movement, in turn, causes plugs 102, 98 to slide downwardly and to close. Then, J-slot mandrel 60 in lower packer 32 is pushed downwardly and pins 64 of lower J-slot mechanism 44 move into position 72, as illustrated in FIG. 12.

With pins 64 in position 72, mandrel 60 and cone 110 are able to slide down relative to slips 108. However, slips 108 and J-slot housing 66 are held in position by the friction force exerted by collet 112 against the surrounding wall 23 of wellbore 22. As a result, cone 110 slides under slips 108 and the slips 108 anchor into the surrounding wellbore wall 23, preventing the lower packer 32 from moving farther down along wellbore 22. The lower sealing element mandrel 94, coupling 106, and mandrel 60, however, are able to continue sliding downwardly until lower packer sealing element 92 bottoms out against end ring 111 and then compresses. The sealing element 92 is compressed until it is forced radially outwardly into sealing engagement with the surrounding wellbore wall 23.

With the lower packer 32 now restrained, packer sealing element 74 of upper packer 30 can compress down onto end ring 78 until sealed against the surrounding wellbore wall 23. The movement also forces slips 84 down against cone 86 which shifts the slips 84 radially outward until anchored against the surrounding wellbore wall 23. At this stage, the straddle packer 20 is anchored in position and isolating the desired section of wellbore 22 corresponding with the desired target formation zone 40.

The fracturing treatment fluid or other type of treatment fluid can then be pumped downhole through, for example, an interior of the coiled tubing 24 and directed into the target formation zone 40 via mandrel injection ports 38. The injection ports 38 may be shaped to minimize erosion due to flow of fluid laden with solids, e.g. proppant. However, the treatment fluid is prevented from flowing through the interior of lower packer 32 via closed plugs 102 and 98. Once the upper 30 and lower 32 packers are set in the third straddle packer position, the target formation zone 40 is now isolated by the upper 30 and lower 32 packers of the straddle packer 20. In this third straddle packer position or isolated position, treatment fluid flowing from the injection ports 38 may not flow past the sealing elements on the upper packer 30 into the wellbore 22 above the upper packer 30 and treatment fluid cannot flow past the elements on the lower packer 32 into the wellbore 22 below the lower packer 32 but rather is directed to the isolated target formation zone 40.

It should be noted that fracturing treatments and other types of well treatments often are performed at high pressures. During the well treatment application, the pressure of the treatment fluid tends to push the end ring 95 downwardly, thus further compressing the packer sealing element 92 and consequently further anchoring slips 108 in wellbore 22. Similarly, the treatment fluid pressure tends to push the end ring 78 of upper packer 30 against packer sealing element 74 to further compress the packer sealing element 74 and to further anchor slips 84 within wellbore 22 during the well treatment. This further compression at the upper packer 30 and lower packer 32 renders the straddle packer 20 self-energizing.

To disengage the straddle packer 20, the treatment fluid pressure is reduced until it equalizes with the non-isolated wellbore pressure. The input applied to coiled tubing 24 is changed from pushing to pulling which shifts the straddle packer 20 to the operational configuration described above with respect to the second position. The straddle packer 20 can then be moved to a different position along wellbore 22 to isolate a different target zone in either an uphole direction (with the straddle packer 20 in the second position) or in a downhole direction (with the straddle packer 20 in the first position). The straddle packer 20 can be cycled to the desired position by applying the appropriate pulling and pushing inputs to the coiled tubing 24 as described above. This setting and unsetting of the packers 30, 32 can be executed multiple times by cycling the packers 30, 32 between expanded configurations sealing against wellbore surface 23 and contracted configurations for movement along wellbore 22.

In some applications, a pressure release mechanism 114, e.g. rupture disk, (see FIG. 4) may be used to release pressure if pressure gets trapped in the isolated zone between packer sealing elements 74 and 92. If such condition occurs, the pressure inside the coiled tubing 24 may be increased to break the rupture disk 114 (or otherwise trigger the release mechanism) to relieve the internal pressure for retrieval of the straddle packer 20. If the straddle packer 20 still cannot be retrieved, release device 28 may be actuated to disconnect the straddle packer 20 from coiled tubing 24. Once released, the straddle packer 20 can be retrieved later by conventional fishing procedures.

The system and methodologies described herein may be employed in a wide variety of well treatment procedures and other procedures utilizing borehole isolation. The overall structure of the straddle packer 20 and the individual packer assemblies 30, 32 may be adjusted according to the parameters of a given application and/or environment. For example, the specific arrangement of components and the materials used to construct those components may vary from one application to another. The packer sealing elements may be made from a variety of elastomeric materials or other suitable materials which enable controlled actuation and sealing along the wellbore. Additionally, various types of sealing elements, slips, collets, plugs, and/or other components may be selected according to the characteristics of a given treatment application. Similarly, the straddle packer 20 may be used in a variety of fracturing treatment applications, other well treatment applications, and other applications utilizing controlled isolation of a borehole section. The well treatment fluids injected may comprise fracturing fluids, water, corrosion resistance fluids, specific formation conditioning fluids, and/or other well treatment fluids.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a wellbore, comprising:

a coiled tubing; and a straddle packer coupled to the coiled tubing, the straddle packer comprising:

a lower packer having a lower sealing element, lower slips, and a lower indexing mechanism;

an upper packer having an upper sealing element, upper slips, and an upper indexing mechanism; and an injection mandrel having injection ports, the injection mandrel being coupled between the upper packer and the lower packer;

the lower indexing mechanism and the upper indexing mechanism cooperating to simultaneously activate or deactivate the lower and upper packers based solely on a force input applied to the straddle packer via the coiled tubing, wherein the force input comprises a compression input or a tension input applied to the straddle packer via the coiled tubing.

2. The system as recited in claim 1, wherein the lower indexing mechanism comprises a lower J-slot indexer having a lower mandrel surrounded by a lower housing, a multi-position profile, and a plurality of pins moved between positions along the multi-position profile upon relative linear movement between the lower mandrel and the lower housing.

3. The system as recited in claim 2, wherein the upper indexing mechanism comprises an upper J-slot indexer having an upper mandrel surrounded by an upper housing, a multi-position profile, and a plurality of pins moved between positions along the multi-position profile upon relative linear movement between the upper mandrel and the upper housing.

4. The system as recited in claim 1, wherein pushing the coiled tubing in a downhole direction applies a compression input which shifts the straddle packer to a first straddle packer position enabling movement of the straddle packer downwardly along the wellbore.

5. The system as recited in claim 4, wherein pulling the coiled tubing in an uphole direction applies a tension input which shifts the straddle packer to a second straddle packer position enabling pulling of the straddle packer from the wellbore or for preparing the straddle packer for activation to isolate a section of the wellbore.

6. The system as recited in claim 5, wherein pushing the coiled tubing in the downhole direction after shifting the straddle packer to the second straddle packer position shifts the straddle packer to a third straddle packer position in which the upper sealing element, upper slips, lower sealing element, and lower slips are activated against a surrounding wellbore surface to isolate the section of the wellbore.

7. The system as recited in claim 1, wherein a treatment fluid is delivered down through the coiled tubing, through the upper packer, and out through the injection ports.

8. The system as recited in claim 7, wherein the lower packer comprises at least one settable plug which may be set to block flow of treatment fluid into the lower packer.

9. The system as recited in claim 7, wherein the treatment fluid comprises a fracturing fluid.

10. A system, comprising:

a first packer having a first packer sealing element which may be actuated to a radially expanded position via linear movement of a first internal sealing element mandrel relative to the first packer sealing element;

a coiled tubing coupled to the first packer;

a second packer having a second packer sealing element which may be actuated to a radially expanded position via linear movement of a second internal sealing element mandrel relative to the second packer sealing element;

a first indexer mechanism coupled to the first internal sealing element mandrel; and a second indexer mechanism coupled to the second internal sealing element mandrel, the first indexer mechanism and the second indexer mechanism being oriented to enable selective and repeatable activation and deactivation of the first and second packer sealing elements via compression or tension inputs applied by the coiled tubing, wherein the first and second indexer mechanisms simultaneously activate or deactivate the first and second packer sealing elements via the same compression or tension input applied to the coiled tubing during operation of the system.

11. The system as recited in claim 10, further comprising an injection mandrel coupled between the first packer and the second packer, the injection mandrel having a plurality of injection ports.

12. The system as recited in claim 11, wherein the first indexer mechanism comprises a first J-slot indexer mechanism.

13. The system as recited in claim 12, wherein the second indexer mechanism comprises a second J-slot indexer mechanism.

14. The system as recited in claim 10, wherein the first packer comprises first slips and the second packer comprise second slips, the first slips and the second slips being selectively set and released via the same compression or tension input.

15. A method, comprising:

moving a straddle packer along a wellbore via coiled tubing, the straddle packer comprising an upper packer and a lower packer with an injection mandrel therebetween;

using a first J-slot indexer and a second J-slot indexer to control actuation of both the upper packer and the lower packer between corresponding expanded and contracted configurations; and simultaneously manipulating both the first J-slot indexer and the second J-slot indexer via a linear force applied the straddle packer via the coiled tubing to simultaneously activate or deactivate the straddle packer, wherein the linear force comprises a compression input or a tension input applied to the straddle packer via the coiled tubing.

16. The method as recited in claim 15, wherein the linear force comprises the compression input, and wherein manipulating comprises pushing the coiled tubing in a downhole direction to apply the compression input and to thus shift the straddle packer to a first straddle packer position enabling movement of the straddle packer downwardly along the wellbore.

17. The method as recited in claim 16, wherein the linear force comprises the tension input, and wherein manipulating comprises pulling the coiled tubing in an uphole direction to apply the tension input and to thus shift the straddle packer to a second straddle packer position enabling pulling of the straddle packer from the wellbore or for preparing the straddle packer for activation to isolate a section of the wellbore.

18. The method as recited in claim 17, wherein manipulating comprises pushing the coiled tubing in the downhole direction after shifting the straddle packer to the second straddle packer position shifts the straddle packer to a third straddle packer position in which the upper packer and lower packer are activated against a surrounding wellbore surface to isolate a section of the wellbore.

19. The method as recited in claim 15, further comprising delivering a treatment fluid down through the coiled tubing, through the upper packer, and out through injection ports of the injection mandrel.

20. The method as recited in claim 19, wherein delivering comprises delivering a fracturing fluid.

* * * * *